US005893060A

United States Patent [19]

Honkanen et al.

[11] Patent Number: 5,893,060

[45] Date of Patent: Apr. 6, 1999

[54] METHOD AND DEVICE FOR ERADICATING INSTABILITY DUE TO PERIODIC SIGNALS IN ANALYSIS-BY-SYNTHESIS SPEECH CODECS

[75] Inventors: Tero Honkanen, Tempere, Finland; Claude LaFlamme; Jean-Pierre Adoul, both of Sherbrooke, Canada

[73] Assignee: Universite de Sherbrooke, Quebec, Canada

[21] Appl. No.: 834,899

[22] Filed: Apr. 7, 1997

[51] Int. Cl.[6] ..... G10L 7/02

[52] U.S. Cl. ..... 704/258; 704/264

[58] Field of Search ..... 704/219, 220, 704/225, 228, 223, 258, 261, 262

[56] References Cited

U.S. PATENT DOCUMENTS 5,687,284 11/1997 Serizawa et al. ..... 704/219
5,708,757 1/1998 Massaloux ..... 704/220

OTHER PUBLICATIONS

ITU–Recommendation G.729–Annex A: Reduced Complexity 8 KBITS/CS–ACELP Speech Codec, 13 pages (Nov./96).

*Primary Examiner*—David R. Hudspeth
*Assistant Examiner*—Harold Zintel
*Attorney, Agent, or Firm*—Merchant, Gould, Smith, Edell, Welter & Schmidt

[57] ABSTRACT

A method and device eradicate the occasional instability inherent in analysis-by-synthesis speech/audio codecs and caused in particular by channel errors during transmission of highly periodic signals such as high-frequency sine waves. Analysis-by-synthesis techniques involve production, in response to the speech/audio signal and at regular time intervals called frames, of (a) a set of spectral parameters for use in driving a synthesis filter in view of synthesizing the speech/audio signal, and (b) a pitch gain for constructing a past-excitation-signal component supplied to the synthesis filter. In accordance with the instability eradication method, the first step consists of detecting a set of conditions including (i) a resonance condition assessed from the spectral parameters, (ii) a duration condition detected when the resonance condition has prevailed for at least the M most recent frames, M being an integer greater than 1, and (iii) a gain condition which evidences consistently-high values of the pitch gain in the N most recent frames, N being an integer greater than 1. To eradicate the occasional instability, the pitch gain is reduced to a value lower than a given threshold whenever these three conditions are detected.

50 Claims, 4 Drawing Sheets

METHOD AND DEVICE FOR ERADICATING INSTABILITY DUE TO PERIODIC SIGNALS IN ANALYSIS-BY-SYNTHESIS SPEECH CODECS

BACKGROUND OF THE INVENTION

1. Field of the Invention

The present invention is concerned with the field of digital encoding of speech, audio and other signals based on analysis-by-synthesis techniques including, in particular but not exclusively, Multipulses, Code Excited Linear Prediction (CELP) and Algebraic-Code Excited Linear Prediction (ACELP). More specifically, the present invention relates to the eradication of an occasional instability found in these analysis-by-synthesis techniques.

2. Brief Description of the Prior Art

Analysis-by-synthesis techniques such as Multipulses, Code Excited Linear Prediction (CELP) and Algebraic-Code Excited Linear Prediction (ACELP) are subjected to occasional instability in particular in the occurrence of channel errors during the transmission of highly periodic signals such as high-frequency sine waves. To circumvent the problem, "Instability-eradication methods", also referred to as "Instability-protection methods", have been developed.

Analysis-by-synthesis speech encoding techniques operate on a frame by frame basis and rely on a speech production model involving the production of (i) a spectrum described by a set of spectral coefficients such as the Line Spectral Pairs (LSP), (ii) a description of an innovation signal typically by way of a codebook and code gain, (iii) a pitch lag, and (iv) its corresponding pitch gain.

At the decoder, a periodic excitation signal is applied to a synthesis filter to produce the output speech. The needed periodic excitation is constructed by adding the received innovation signal to a version of the past excitation signal, namely, reusing the excitation signal a pitch-lag ago multiplied by the pitch gain. Clearly, this construction method is recursive and therefore exhibits a propensity to instability if the pitch gain is allowed to exceed unity.

In analysis-by-synthesis speech encoding techniques, best results are obtained when the pitch gain is allowed to range up to values above one and typically up to 1.2. There is no intrinsic problem with using such a range insofar as the decoder follows rigorously the transmitted instructions from the encoder. However, the combination of channel error and high pitch gain values can bring about instabilities. These problems surfaced during the extensive test programs used by the International Telecommunication Union (ITU) and other standardization bodies.

In the ITU G.729 speech-coding recommendation the problem was solved using a method to anticipate at the encoder a problem potential by monitoring the past excitation.

OBJECTS OF THE INVENTION

An object of the invention is to eradicate the occasional instability which is known to occur in analysis-by-synthesis speech encoding techniques such as Multipulses, Code Excited Linear Prediction (CELP), and Algebraic-Code Excited Linear Prediction (ACELP).

Another object of the invention is to make the best use of parameters already available at the encoder to identify accurately a problem potential in order to take the proper action at the encoder that will eliminate any risk of channel error inducing instability at the decoder.

A further object of the present invention is to provide an instability eradication method and device capable of providing protection against all known problem signals including DTMF (i-e.: Touch tone signals) and other signalling tones yet without causing any interference with the encoding of speech signals.

SUMMARY OF THE INVENTION

More specifically, the present invention relates to a method for eradicating an occasional instability occurring in analysis-by-synthesis techniques for encoding an input signal, this analysis-by-synthesis techniques involving production, in response to the input signal and at regular time intervals called frames, of (a) a set of spectral parameters for use in driving a synthesis filter in view of synthesizing the input signal, and (b) a pitch gain for constructing a past-excitation-signal component for supply to the synthesis filter. According to the invention, the instability eradication method comprises a detection step for detecting a set of conditions related to the spectral parameters and the pitch gain, and a modification step for reducing the pitch gain to a value lower than a given threshold whenever the conditions of the above mentioned set are detected in order to eradicate the occasional instability.

Advantageously, the conditions of the above mentioned set comprise:

- a resonance condition assessed from the spectral parameters;
- a duration condition detected when the resonance condition has prevailed for at least the M most recent frames, M being an integer greater than 1; and
- a gain condition which evidences consistently-high values of the pitch gain in the N most recent frames, N being an integer greater than 1.

In accordance with a preferred embodiment, the spectral parameters are related to spectral pairs selected from the group consisting of Line Spectral Pairs (LSP) and Immitance Spectral Pairs (ISP).

When the spectral parameters are related to Line Spectral Pairs (LSP), the resonance condition is advantageously related to differences between these Line Spectral Pairs (LSP).

The modification step may comprise the step of reducing a quantized version of the pitch gain to a value lower than a given threshold $G_T$ whenever the conditions of the above mentioned set are detected in order to eradicate the occasional instability.

Alternatively, the modification step may comprise saturating the pitch gain to a given threshold whenever the conditions of the set are detected in order to eradicate the occasional instability.

If the analysis-by-synthesis techniques comprise quantizing the pitch gain by means of a vector quantizer, the modification step may comprise limiting a search range of the vector quantizer to thereby cause the quantized pitch gain to be lower than a given threshold whenever the conditions of the set are detected in order to eradicate the occasional instability.

If the spectral parameters are related to Line Spectral Pairs (LSP):

(a) the detection step advantageously comprises:
comparing quantities $d_k$ to respective thresholds $T_k$ and detecting a resonance condition when at least one quantity $d_k$ is higher than the respective threshold $T_k$;
wherein the quantities $d_k$ are expressed by the following relation:

$$d_k=\min\{LSP(i)-LSP(i+1)\};\ \text{for } i=m_k, m_{k+1}, \ldots, n_k$$

where:

LSP(i) for I=1, 2, . . . P, denotes P spectral parameters of the Line Spectral Pairs (LSP);

k is an index; and $m_k$, $m_{k+1}$, . . . , $n_k$ are integers; and (b) the instability eradication method advantageously comprises changing the value of at least one threshold $T_k$ in relation to the Line Spectral Pairs (LSP).

Preferably, the detection step comprises detecting a gain condition when an average of the pitch gain over the N most recent frames is higher than a given threshold, or when a weighting of the pitch gain over the N most recent frames is higher than a given threshold.

The instability eradication method may further comprise, when an overflow occurs in the synthesis filter in response to the past-excitation-signal component, the step of scaling down this past-excitation-signal component in order to enhance eradication of the occasional instability.

The present invention also relates to a method for eradicating an occasional instability occurring in analysis-by-synthesis techniques for encoding an input signal, this analysis-by-synthesis techniques involving production, in response to the input signal and at regular time intervals called frames, of (a) a set of spectral parameters for use in driving a synthesis filter in view of synthesizing the input signal, and (b) a pitch gain for constructing a past-excitation-signal component for supply to the synthesis filter. This instability eradication method comprises:

a detection step for detecting a set of conditions related to the spectral parameters and the pitch gain; and a modification step for reducing the pitch gain to a value lower than a given threshold whenever the conditions of the above mentioned set are detected in order to eradicate the occasional instability;

wherein the conditions of the set comprise:

a resonance condition assessed from the spectral parameters;

a duration condition detected when the resonance condition has prevailed for at least the M most recent frames, M being an integer greater than 1; and a gain condition which evidences consistently-high values of the pitch gain in the N most recent frames, N being an integer greater than 1; and wherein the detection step comprises:

comparing the quantities $$d_1=\min\{LSP(i)-LSP(i+1)\};\ \text{for } i=4, 5, 6, 7, 8$$

$$d_2=\min\{LSP(i)-LSP(i+1)\};\ \text{for } i=2, 3$$

to the thresholds $T_1$ and $T_2$, respectively; and detecting a resonance condition when at least one of the quantities $d_1$ and $d_2$ is higher than the respective threshold $T_1$ or $T_2$;

where

LSP(i) for I=2, 3, 4, 5, 6, 8, denotes spectral parameters of the Line Spectral Pairs (LSP).

Advantageously, the detection step further comprises:

maintaining the threshold $T_1$ to a fixed value; and changing the value of the threshold $T_2$ in relation to the spectral parameter LSP(2).

The present invention further relates to a device for conducting the method according to the invention, comprising: detecting means for detecting a set of conditions related to the spectral parameters and the pitch gain, and modifying means for reducing the pitch gain to a value lower than a given threshold whenever the conditions of the above mentioned set are detected in order to eradicate the occasional instability.

Also in accordance with the present invention, there is provided an encoder system comprising:

an analysis-by-synthesis encoder section for encoding an input signal, comprising:

first means for producing, in response to the input signal and at regular time intervals called frames, a description of an innovation signal to be supplied as excitation signal to a synthesis filter in view of synthesizing this input signal;

second means for producing, in response to the input signal and at the regular time intervals, a set of spectral parameters for use in driving the synthesis filter; and third means for producing, in response to the input signal and at the regular time intervals, pitch information including a pitch gain for constructing a past-excitation-signal component added to the excitation signal; and an instability eradication section comprising:

detecting means for detecting a set of conditions related to the spectral parameters and the pitch gain; and modifying means for reducing the pitch gain to a value lower than a given threshold whenever the conditions of the above mentioned set are detected in order to eradicate the occasional instability.

Further in accordance with the present invention, in a cellular communication system for servicing a large geographical area divided into a plurality of cells, comprising:

mobile transmitter/receiver units;

cellular base stations respectively situated in the cells;

means for controlling communication between the cellular base stations;

a bidirectional wireless communication sub-system between each mobile unit situated in one cell and the cellular base station of said one cell, the bidirectional wireless communication sub-system comprising in both the mobile unit and the cellular base station (a) a transmitter including analysis-by-synthesis encoding means for encoding a speech signal and means for transmitting the encoded speech signal, and (b) a receiver including means for receiving a transmitted encoded speech signal and means for decoding the received encoded speech signal;

the improvement comprises the analysis-by-synthesis speech signal encoding means of the transmitter of at least a portion of the mobile units and cellular base stations provided with an encoder system including an analysis-by-synthesis encoder section for encoding the speech signal, comprising:

first means for producing, in response to the speech signal and at regular time intervals called frames, a description of an innovation signal to be supplied as excitation signal to a synthesis filter in view of synthesizing the speech signal;

second means for producing, in response to the speech signal and at the regular time intervals, a set of spectral parameters for use in driving the synthesis filter; and third means for producing, in response to the speech signal and at the regular time intervals, pitch information including a pitch gain for constructing a past-excitation-signal component added to the excitation signal; and an instability eradication section comprising (a) detecting means for detecting a set of conditions related to the spectral parameters and the pitch gain; and (b) modifying means for reducing the pitch gain to a value lower than a given threshold whenever the conditions of the set are detected in order to eradicate the occasional instability.

The objects, advantages and other features of the present invention will become more apparent upon reading of the following non restrictive description of a preferred embodiment thereof, given by way of example only with reference to the accompanying drawings.

DETAILED DESCRIPTION OF THE PREFERRED EMBODIMENT

Although application of the instability eradicating method and device according to the present invention to a cellular communication system is disclosed as a non limitative example in the present specification, it should be kept in mind that these method and device can be used with the same advantages in many other types of communication systems in which signal encoding is required.

Figure 4:
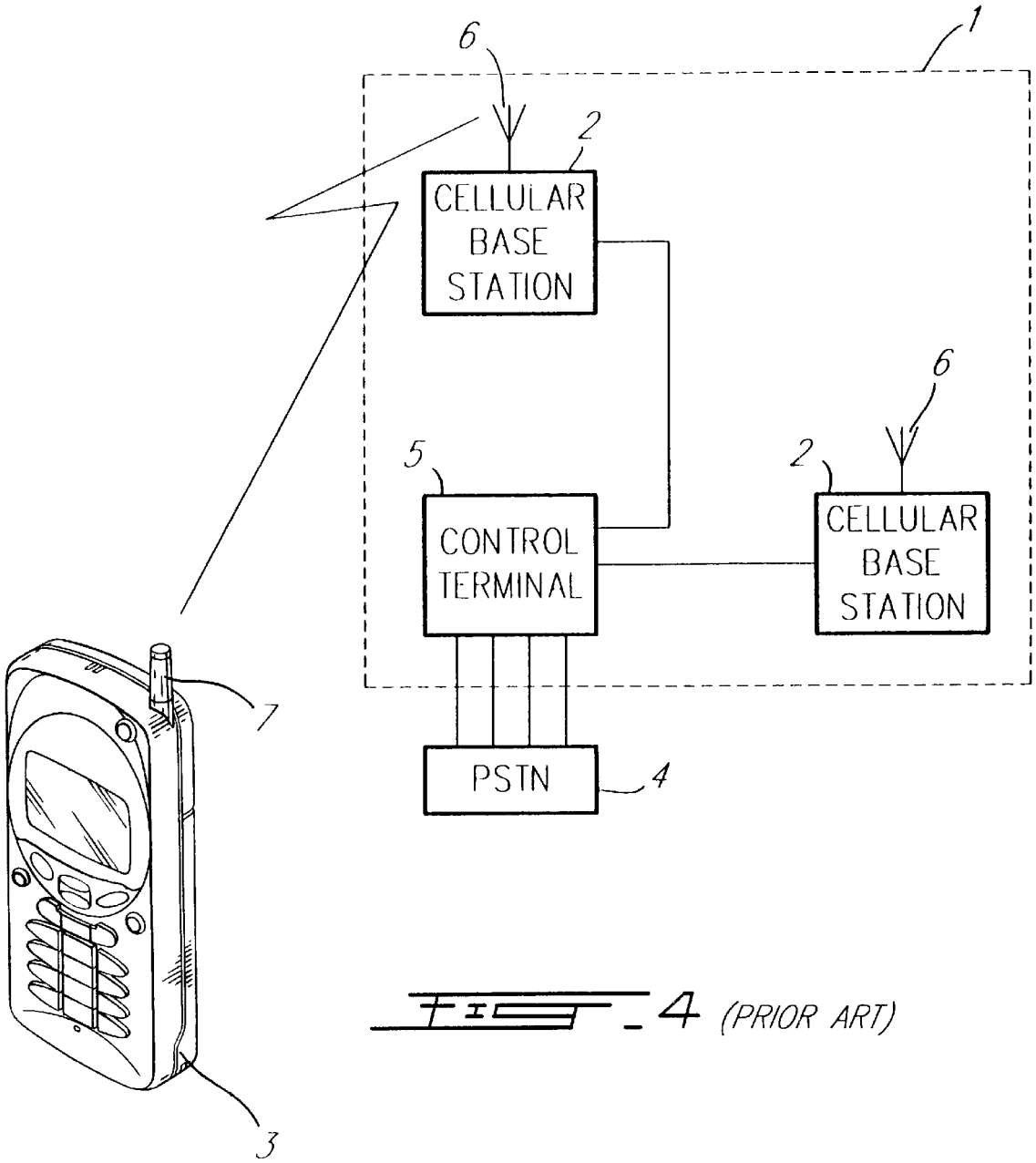
FIG. 4 (PRIOR ART)
FIG. 4 is a schematic block diagram illustrating the infrastructure of a typical cellular communication system.

In a cellular communication system such as 1 (FIG. 4), a telecommunication service is provided over a large geographic area by dividing that large area into a number of smaller cells. Each cell has a cellular base station 2 for providing radio signalling channels, and audio and data channels.

The radio signalling channels are utilized to page mobile radio telephones (mobile transmitter/receiver units) such as 3 within the limits of the cellular base station's coverage area (cell), and to place calls to other radio telephones 3 either inside or outside the base station's cell, or onto another network such as the Public Switched Telephone Network (PSTN) 4.

Once a radio telephone 3 has successfully placed or received a call, an audio or data channel is set up with the cellular base station 2 corresponding to the cell in which the radio telephone 3 is situated, and communication between the base station 2 and radio telephone 3 occurs over that audio or data channel. The radio telephone 3 may also receive control or timing information over the signalling channel whilst a call is in progress.

If a radio telephone 3 leaves a cell during a call and enters another cell, the radio telephone hands over the call to an available audio or data channel in the now cell. Similarly, if no call is in progress a control message is sent over the signalling channel such that the radio telephone 3 logs onto the base station 2 associated with the new cell. In this manner mobile communication over a wide geographical area is possible.

The cellular communication system 1 further comprises a terminal 5 to control communication between the cellular base stations 2 and the PSTN 4, for example during a communication between a radio telephone 3 and the PSTN 4, or between a radio telephone 3 in a first cell and a radio telephone 3 in a second cell.

Of course, a bidirectional wireless radio communication sub-system is required to establish communication between each radio telephone 3 situated in one cell and the cellular base station 2 of that cell. Such a bidirectional wireless radio communication system typically comprises in both the radio telephone 3 and the cellular base station 2 (a) a transmitter for encoding the speech signal (the transmitter is usually provided with an analysis-by-synthesis speech/audio encoder for encoding the speech signal) and for transmitting the encoded speech signal through an antenna such as 6 or 7, and (b) a receiver for receiving a transmitted encoded speech signal through the same antenna 6 or 7 and for decoding the received encoded speech signal. As well known to those of ordinary skill in the art, voice encoding is required in order to reduce the bandwidth necessary to transmit speech across the bidirectional wireless radio communication system, i.e. between a radio telephone 3 and a base station 2.

Figure 1:
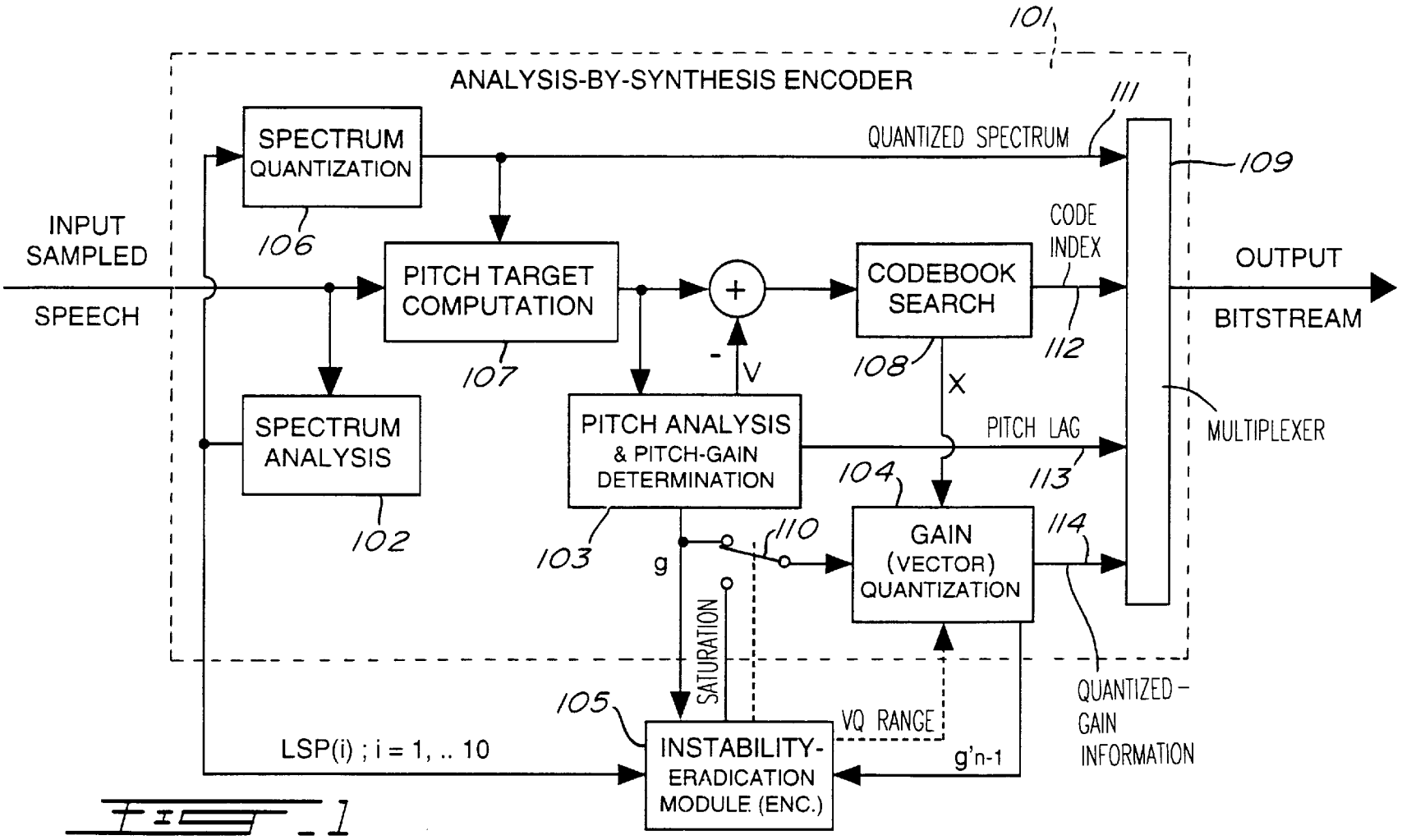
FIG. 1 is a simplified block diagram of an analysis-by-synthesis speech/audio encoder comprising an instability-eradication module in accordance with the present invention.
Figure 3:
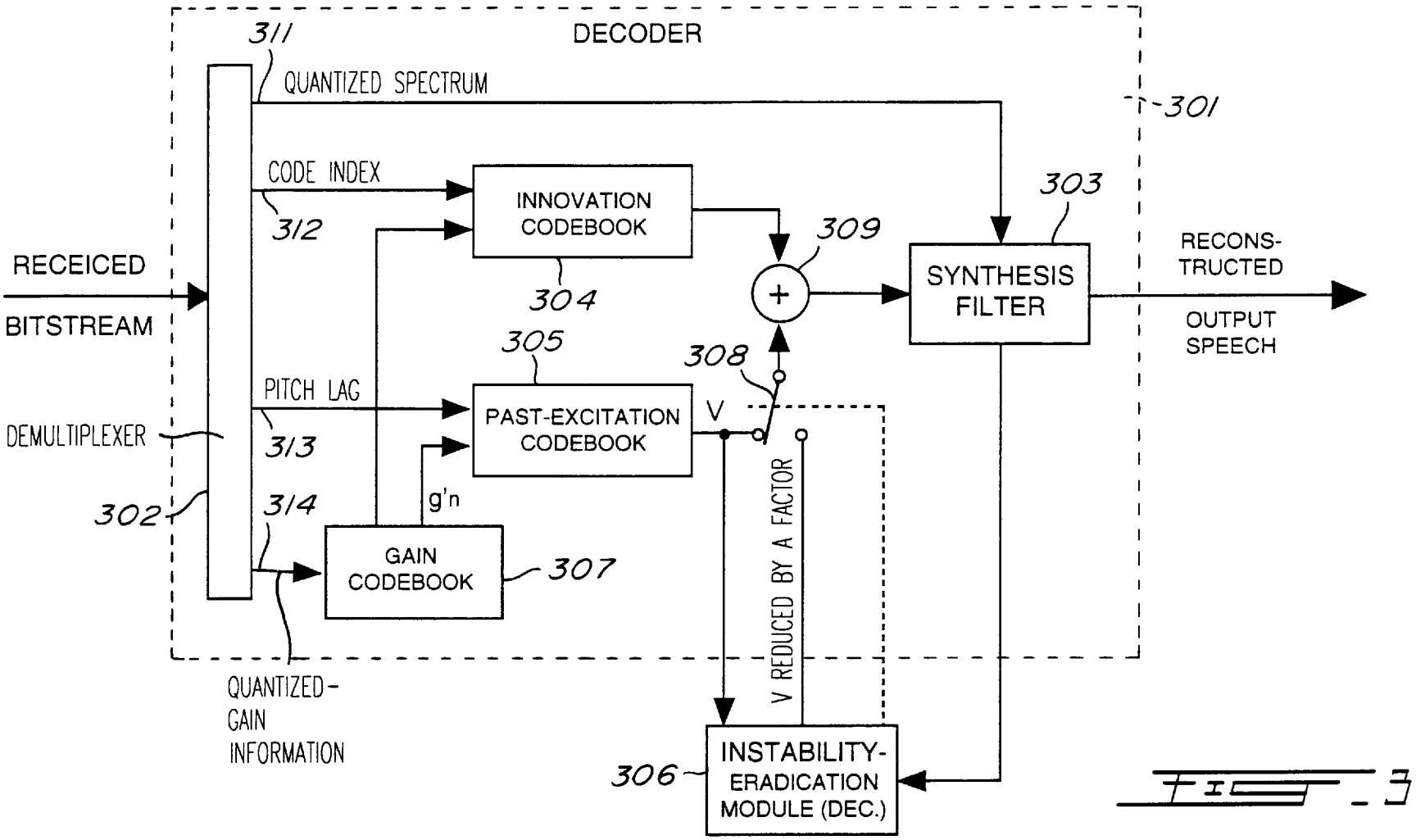
FIG. 3 is a simplified block diagram of a decoder as used in conjunction with the analysis-by-synthesis encoder of FIG. 1, comprising an instability-eradication module.

The present invention aims at providing the encoder of the transmitter of both the radio telephones 3 and the cellular base stations 2 with a device for eradicating the above discussed occasional instability occurring in analysis-by-synthesis techniques. FIG. 1 is a schematic block diagram of an analysis-by-synthesis encoder provided with a device according to the invention for eradicating said occasional instability. FIG. 3 is a schematic block diagram of a decoder usable in conjunction with the encoder of FIG. 1.

Although the preferred embodiment of the instability eradicating method and device according to the invention will be described in relation to an analysis-by-synthesis speech encoding technique, it should be kept in mind that the present invention also applies to analysis-by-synthesis techniques for encoding audio and other signals.

Analysis-by-synthesis speech encoding techniques are based on a speech production model involving as shown in FIG. 1 the production of:

(a) a quantized spectrum 111 described by a set of P spectral coefficients, where P is the order;

(b) a description of an innovation signal typically by way of a code index 112 and a code gain (included in the quantized-gain information 114);

(c) a pitch lag 113; and (d) a pitch gain (included in the quantized gains 114).

Signals 111–114 are supplied to respective inputs of a multiplexer 109. The multiplexer 109 multiplexes the signals 111–114 to produce a corresponding bitstream transmitted to a decoder as shown in FIG. 3.

The decoder 301 of FIG. 3 comprises a demultiplexer 302 for demultiplexing the bitstream received from the encoder 101 of FIG. 1 into a quantized spectrum 311 (corresponding to transmitted spectrum 111), a code index 312 (corresponding to transmitted code index 112), a pitch lag 313 (corresponding to transmitted pitch lag 113) and to quantized-gain information 314 (corresponding to transmitted quantized gains 114). The reconstructed speech is outputted from a synthesis filter 303. This synthesis filter 303 is excited by the sum of two components, namely (a) a codevector from an innovation codebook 304 in response to the code index information 312 and the code gain extracted from the quantized gain information 314 by a gain codebook 307, and (b) a past-excitation component v from a past-excitation-codebook 305 in response to the received pitch-lag information 313 and the pitch gain retrieved by the gain codebook 307 from the quantized-gain information 314. The spectrum 311 is also used to drive the synthesis filter 303. More specifically, a periodic excitation signal is applied to the synthesis filter 303 to produce the desired output speech, this periodic excitation signal being constructed by adding the received innovation signal to a past-excitation-signal component, more precisely to the excitation signal a pitch-lag ago multiplied by the pitch gain. Whenever the frame duration is longer than the pitch lag, the frame is filled by repeating the past excitation according to the well known adaptive codebook technique.

Clearly, the periodic-excitation-signal construction procedure just described is recursive and therefore exhibits a propensity to instability if the pitch gain is allowed to dwell near, or to exceed, unity.

In fact, in analysis-by-synthesis speech encoding techniques, best results are obtained when the pitch gain is allowed to rise to unity and above, say, to range up to 1.2 for the sake of an example. There is no intrinsic problem with using such a range insofar as the decoder follows rigorously the transmitted instructions from the encoder. However, the combination of channel error and highly correlated stationary signals which keep the pitch gain continuously high may give rise to instabilities that will cause the decoder to utterly derail.

The instability eradicating method and device according to the invention make the best use of parameters already available at the encoder to determine accurately if one faces a problem potential, namely if one stands the chance of channel errors inducing instability at the decoder. Inasmuch as the encoder can be made aware of a problem potential, instability can be avoided by simply limiting the pitch gain to values lower than a given threshold itself lower than unity.

The instability-eradication method according to the invention will be best understood by turning first to FIG. 1.

FIG. 1 shows the analysis-by-synthesis speech/audio encoder 101 comprising a spectrum analysis module 102, a pitch analysis and pitch-gain determination module 103, a gain (vector) quantization module 104, a spectrum quantization module 106, a pitch target computation module 107, a codebook search module 108, the multiplexer 109, and the switch 110. The present invention concerns an instability-eradication module 105.

Switch 110 is normally in the position as shown in FIG. 1. In this case, the instability-eradication module 105 does not interfere with normal operation of the encoder 101; indeed the pitch gain g outputted from module 103 is passed untouched to the quantization module 104. If however, the instability-eradication module 105 identifies a problem potential, it will change the position of switch 110 thereby saturating the current pitch gain g to some value (e.g.: $G_T$) and will cause the quantized pitch gain included in the output of gain vector-quantization module 104 to be limited to a value lower than a given threshold (e.g.: $G_T$).

The spectrum analysis module 102 extracts a set of Linear Prediction (LP) coefficients from the sampled input signal according to the well-known linear-prediction analysis procedure. These parameters are typically transformed into another representation wherein quantization thereof can be done more efficiently by module 106 to produce the quantized spectrum 111. The most popular LP-coefficient transformed representation is the Line Spectral Pairs (LSP) also called the Line Spectral Frequencies (LSF) when expressed in a linear frequency scale. A related representation which has similar properties is the Immitance Spectral Pairs (ISP). These representations use a set of ordered parameters "LSP (i)" ranging in the ±1 interval, where i assumes the integers from 1 to P, where P is the linear-prediction order which is typically 10, and where the well-known property LSP(i) greater than LSP(i+1) holds for I=1, 2 . . . (P−1).

Module 103 is a conventional pitch analysis and pitch-gain determination module responsive to a pitch target computed from the input sampled speech signal by conventional module 107 to produce an ideal pitch gain g, the pitch lag information 113, and a past-excitation signal component v.

The (vector) quantization module 104 quantizes the inputted pitch gain g. Note that, under normal conditions, gain g is the same as outputted by module 103. In some implementations, g is scalar quantized into $g'_n=Q(g)$ where n is the frame index. In other implementations, including the one depicted in FIG. 1, one or two coding bit(s) can be saved by vector quantizing g jointly with x where x is some variable to be transmitted such ar the code gain produced by the codebook search module 108. In this case we can note $g'_n=Q(g,x)$.

Just a word to mention that module 108 is a conventional codebook search module 108 responsive to the pitch target from the pitch target computation module 107 with the past-excitation signal component v removed to produce the code index information 112.

The instability-eradication module 105 is used in conjunction with the encoder 101. Its purpose is to identify frames with problem potential and, whenever such frames occur, to saturate the current pitch gain g to a given value and to cause the quantized version of the pitch gain to assume a value lower than unity in the vector quantization process. This result is best obtained by limiting the vector-quantizer search range to those entries for which the corresponding quantized pitch gain assumes indeed the above mentioned value lower than unity.

A frame with problem potential is identified whenever the three following conditions are detected:

1) A resonance condition prevails in the input signal to be encoded. In other words a highly correlated stationary signal is present. A typical signal having these characteristics is a sinusoidal tone or a combination of tones. The present specification discloses an efficient approach to assessing resonance conditions by monitoring the occurrence of resonance in the LSP-spectrum already available in the encoder.
2) A duration condition is detected when the resonance condition has prevailed for at least the M most recent frames where M is an integer greater than 1; a typical value for M is 12.
3) A gain condition which evidences consistently-high values of the pitch gain in the N most recent frames, N being an integer greater than 1. For example, a consistently-high pitch-gain condition is detected when the average pitch gain computed over the most recent N+1 pitch-gain values exceeds a given threshold; a typical value for N is 7.

Figure 2:
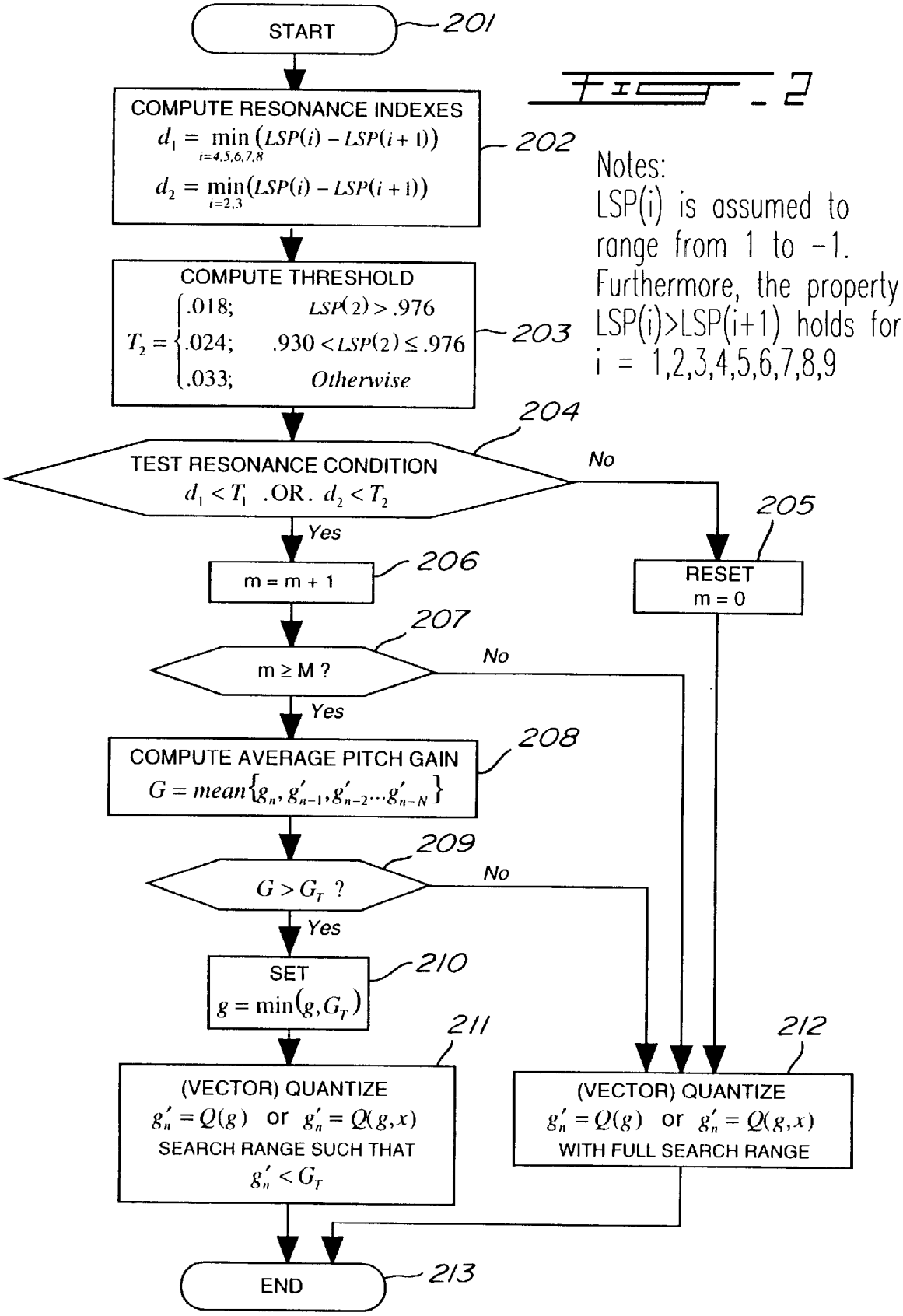
FIG. 2 is a flow chart describing the method used by the instability-eradication module of the encoder of FIG. 1.

The various steps of the instability eradicating method are illustrated in the flow chart of FIG. 2. It should be kept in mind that FIG. 2 illustrates a preferred embodiment of the instability eradicating method according to the invention; clearly, there are alternate ways that can be devised by a speech encoding expert to detect the above three conditions without departing from the spirit of the present invention.

In essence, steps 201 through 204 determines whether or not a resonance condition prevails in the input speech signal to be encoded. If a resonance condition is detected, steps 206 and 207 determines whether the duration, during which the resonance condition has been prevailing, exceeds a given number of frames (duration condition). If this duration condition is detected, a problem potential is recognized if the (weighted) average pitch gain is above a given threshold and the current pitch gain is above a certain threshold $G_T$. When a problem potential is recognized, the quantized pitch gain $g'_n$ is caused to stay below a certain threshold (e.g.: $G_T$) in step 211 by limiting the search range of the vector quantization module 104 (FIG. 1).

Resonance condition

In step 202, two resonance indexes, $d_1$ and $d_2$, are computed by considering the smallest difference between consecutive (unquantized) spectral parameters LSP(i) outputted by the spectrum analysis module 102 of FIG. 1. For that purpose, the following relations are used:

$$d_1=\min\{LSP(i)-LSP(i+1)\};\ \text{for } i=4, 5, 6, 7, 8$$

$$d_2=\min\{LSP(i)-LSP(i+1)\};\ \text{for } i=2, 3$$

It should be kept in mind that alternate resonance indexes can be defined by considering the difference between LSP(i) and LSP(i+2) instead of adjacent LSPs.

In step 204 a resonance condition is detected if either $d_1$ or $d_2$ exceeds their respective thresholds $T_1$ or $T_2$.

Basically, threshold $T_1$ concerns resonances occurring in higher frequencies. Good result are obtained with a fixed threshold $T_1$. A typical value for threshold $T_1$ is 0.0458.

It is a purpose of the invention to disclose that problematic resonances occurring in the lower frequencies can be detected providing $T_2$ is not fixed. In the preferred implementation described in step 203, there are three different values that $T_2$ can assume depending on the value of LSP(2). Such a frequency dependent threshold $T_2$ is needed because, in the lower frequency range, the speech signal exhibits the high-energy stationary resonances called formants and therefore extra care must be taken to stamp out false alarms that would degrade speech quality. It was discovered that binding the threshold value to the 2nd LSP parameter in the appropriate way prevents detrimental false alarm without sacrificing the protection performance for real problem signals.

Duration condition

Steps 206 and 207 detect the duration condition when the resonance condition detected in step 204 has prevailed for at least the M most recent frames.

Gain condition

Step 209 detects a problem potential by detecting the consistently-high pitch-gain condition when the average G of the pitch gain over the N most recent frames, computed in step 208, is higher than a fixed threshold $G_T$, where 0.95 is a typical value for $G_T$ according to the implementation illustrated in step 208. Note that alternative "weighted average" G can be obtained using linear filtering or any function, of the current and previous pitch gains without departing from the spirit of the present invention. In the latter case, a gain condition is detected when such "weighting" of the pitch gain over the N most recent frames is higher than a given threshold.

If a problem potential is detected

Step 210 saturates the pitch gain g to $G_T$ or another threshold (a simpler variant for step 210 consists of setting $g=G_T$ because g is expected to be large on entering this step).

The quantization operation of step 211 takes place in vector-quantization module 104 under instructions from the instability-eradication module 105 to limit the search range to codevectors corresponding to quantized pitch gains lower than $G_T$ or similar value.

If the answer to step 204 is "No", the number m of frames during which the resonance condition has prevailed is reset to zero (step 205) and the pitch gain is vector quantized with the full search range by the module 104 of FIG. 1 (step 212).

In the same manner, should the answer to steps 207 or 209 be "No", the pitch gain is vector quantized with the full search range by the module 104 of FIG. 1 (step 212).

The following simple additional safety feature can be used at the decoder 301 (FIG. 3) to further enhance the instability eradicating method in accordance with the present invention. Referring to FIG. 3, whenever an overflow occurs in synthesis filter 303 in response to the past-excitation-signal component v, an instability-eradication module 306 changes the position of the switch 308 and scales down by a certain factor such as 4 this past-exaltation-signal component v. More specifically, when an overflow occurs in synthesis filter 303 in response to the past-excitation-signal component v, this overflow is detected by the instability-eradication module 306 which then changes the position of the switch 308, scales down by a certain factor such as 4 this past-excitation-signal component v, and supplies the scaled down past-excitation-signal component v to the adder 309.

Although the present invention has been described hereinabove by way of a preferred embodiment thereof, this embodiment can be modified at will, within the scope of the appended claims, without departing from the spirit and nature of the subject invention.

What is claimed is:

1. A method for eradicating an occasional instability occurring in analysis-by-synthesis techniques for encoding an input signal, said analysis-by-synthesis techniques involving production, in response to said signal and at regular time intervals called frames, of:

(a) a set of spectral parameters for use in driving a synthesis filter in view of synthesizing said signal; and (b) a pitch gain for constructing a past-excitation-signal component for supply to the synthesis filter;

said instability eradication method comprising:

a detection step for detecting a set of conditions related to the spectral parameters and the pitch gain; and a modification step for reducing the pitch gain to a value lower than a given threshold whenever the conditions of said set are detected in order to eradicate said occasional instability.

2. An instability eradication method as recited in claim 1, wherein the conditions of said set comprise:

a resonance condition assessed from the spectral parameters;

a duration condition detected when the resonance condition has prevailed for at least the M most recent frames, M being an integer greater than 1; and a gain condition which evidences consistently-high values of the pitch gain in the N most recent frames, N being an integer greater than 1.

3. An instability eradication method as recited in claim 1, wherein the spectral parameters are related to spectral pairs selected from the group consisting of Line Spectral Pairs (LSP) and Immitance Spectral Pairs (ISP).

4. An instability eradication method as recited in claim 2, wherein the spectral parameters are related to Line Spectral Pairs (LSP), and wherein the resonance condition is related to differences between said Line Spectral Pairs (LSP).

5. An instability eradication method as recited in claim 1, in which said modification step comprises the step of reducing a quantized version of the pitch gain to a value lower than a given threshold $G_T$ whenever the conditions of said set are detected in order to eradicate said occasional instability.

6. An instability eradication method as recited in claim 1, wherein said modification step comprises saturating the pitch gain to a given threshold whenever the conditions of said set are detected in order to eradicate said occasional instability.

7. An instability eradication method as recited in claim 1, wherein said analysis-by-synthesis techniques comprise quantizing the pitch gain by means of a vector quantizer, and wherein said modification step comprises limiting a search range of the vector quantizer to thereby cause the quantized pitch gain to be lower than a given threshold whenever the conditions of said set are detected in order to eradicate said occasional instability.

8. An instability eradication method as recited in claim 2, wherein the spectral parameters are related to Line Spectral Pairs (LSP), and wherein the detection step comprises:

comparing quantities $d_k$ to respective thresholds $T_k$; and detecting a resonance condition when at least one quantity $d_k$ is higher than the respective threshold $T_k$;

wherein said quantities $d_k$ are expressed by the following relation:

$$d_k=\min\{\mathrm{LSP}(i)-\mathrm{LSP}(i+1)\};\ \text{for } i=m_k, m_{k+1}, \ldots, n_k$$

where:

LSP(i) for I=1, 2, . . . P, denotes P spectral parameters of the Line Spectral Pairs (LSP);

k is an index; and $m_k$, $m_{k+1}$, . . . , $n_k$ are integers.

9. An instability eradication method as recited in claim 8, comprising changing the value of at least one threshold $T_k$ in relation to the Line Spectral Pairs (LSP).

10. An instability eradication method as recited in claim 2, wherein the detection step comprises detecting a gain condition when an average of the pitch gain over said N most recent frames is higher than a given threshold.

11. An instability eradication method as recited in claim 2, wherein the detection step comprises detecting a gain condition when a weighting of the pitch gain over the N most recent frames is higher than a given threshold.

12. An instability eradication method as recited in claim 1, further comprising, when an overflow occurs in the synthesis filter in response to the past-excitation-signal component, the step of scaling down said past-excitation-signal component in order to enhance eradication of the occasional instability.

13. A method for eradicating an occasional instability occurring in analysis-by-synthesis techniques for encoding an input signal, said analysis-by-synthesis techniques involving production, in response to said signal and at regular time intervals called frames, of (a) a set of spectral parameters for use in driving a synthesis filter in view of synthesizing said signal, and (b) a pitch gain for constructing a past-excitation-signal component for supply to the synthesis filter;

said instability eradication method comprising:

a detection step for detecting a set of conditions related to the spectral parameters and the pitch gain; and a modification step for reducing the pitch gain to a value lower than a given threshold whenever the conditions of said set are detected in order to eradicate said occasional instability;

wherein the conditions of said set comprise:

a resonance condition assessed from the spectral parameters;

a duration condition detected when the resonance condition has prevailed for at least the M most recent frames, M being an integer greater than 1; and a gain condition which evidences consistently-high values of the pitch gain in the N most recent frames, N being an integer greater than 1;

wherein the detection step comprises:

comparing the quantities $$d_1=\min\{\mathrm{LSP}(i)-\mathrm{LSP}(i+1)\};\ \text{for } i=4, 5, 6, 7, 8$$

$$d_2=\min\{\mathrm{LSP}(i)-\mathrm{LSP}(i+1)\};\ \text{for } i=2, 3$$

to the thresholds $T_1$ and $T_2$, respectively; and detecting a resonance condition when at least one of the quantities $d_1$ and $d_2$ is higher than the respective threshold $T_1$ or $T_2$; where LSP(i) for i=2, 3, 4, 5, 6, 7, 8, denotes spectral parameters of the Line Spectral Pairs (LSP).

14. An instability eradication method as recited in claim 13, wherein the detection step further comprises:

maintaining the threshold $T_1$ to a fixed value; and changing the value of the threshold $T_2$ in relation to the spectral parameter LSP(2).

15. A device for eradicating an occasional instability occurring in analysis-by-synthesis techniques for encoding an input signal, said analysis-by-synthesis techniques involving production, in response to said signal and at regular time intervals called frames, of:

(a) a set of spectral parameters for use in driving a synthesis filter in view of synthesizing said signal; and (b) a pitch gain for constructing a past-excitation-signal component for supply to the synthesis filter;

said instability eradication device comprising:

detecting means for detecting a set of conditions related to the spectral parameters and the pitch gain; and modifying means for reducing the pitch gain to a value lower than a given threshold whenever the conditions of said set are detected in order to eradicate said occasional instability.

16. An instability eradication device as recited in claim 15, wherein the conditions of said set comprise:

a resonance condition assessed from the spectral parameters;

a duration condition detected when the resonance condition has prevailed for at least the M most recent frames, M being an integer greater than 1; and a gain condition which evidences consistently-high values of the pitch gain in the N most recent frames, N being an integer greater than 1.

17. An instability eradication device as recited in claim 15, in which said modifying means comprises means for reducing a quantized version of the pitch gain to a value lower than a given threshold $G_T$ whenever the conditions of said set are detected by the detecting means in order to eradicate said occasional instability.

18. An instability eradication device as recited in claim 15, wherein said modifying means comprises means for saturating the pitch gain to a given threshold whenever the conditions of said set are detected in order to eradicate said occasional instability.

19. An instability eradication device as recited in claim 15, wherein said analysis-by-synthesis techniques use a vector quantizer for quantizing the pitch gain, and wherein said modifying means comprises means for limiting a search range of the vector quantizer to thereby cause the quantized pitch gain to be lower than a given threshold whenever the conditions of said set are detected in order to eradicate said occasional instability.

20. An instability eradication device as recited in claim 16, wherein the spectral parameters are related to Line Spectral Pairs (LSP), and wherein the detecting means comprises:

means for comparing quantities $d_k$ to respective thresholds $T_k$; and means for detecting a resonance condition when at least one quantity $d_k$ is higher than the respective threshold $T_k$;

wherein said quantities $d_k$ are expressed by the following relation:

$$d_k=\min\{\mathrm{LSP}(i)-\mathrm{LSP}(i)\};\ \text{for } i=m_k, m_{k+1}, \ldots, n_k$$

where:

LSP(i) for I=1, 2, . . . P, denotes P spectral parameters of the Line Spectral Pairs (LSP);

k is an index; and $m_k$, $m_{k+1}$, . . . , $n_k$ are integers.

21. An instability eradication device as recited in claim 20, comprising means for changing the value of at least one threshold $T_k$ in relation to the Line Spectral Pairs (LSP).

22. An instability eradication device as recited in claim 20, wherein:

the index k takes on the two values 1 and 2; and the detecting means comprises:

means for comparing the quantities $$d_1=\min\{\mathrm{LSP}(i)-\mathrm{LSP}(i+1)\};\ \text{for } i=4, 5, 6, 7, 8$$

$$d_2=\min\{\mathrm{LSP}(i)-\mathrm{LSP}(i+1)\};\ \text{for } i=2, 3$$

to the thresholds $T_1$ and $T_2$, respectively; and means for detecting a resonance condition when at least one of the quantities $d_1$ and $d_2$ is higher than the respective threshold $T_1$ or $T_2$.

23. An instability eradication device as recited in claim 22, wherein the detecting means further comprises:

means for maintaining the threshold $T_1$ to a fixed value; and means for changing the value of the threshold $T_2$ in relation to the spectral parameter LSP(2).

24. An instability eradication device as recited in claim 16, wherein the detecting means comprises means for detecting a gain condition when an average of the pitch gain over said N most recent frames is higher than a given threshold.

25. An instability eradication device as recited in claim 16, wherein the detecting means comprises means for detecting a gain condition when a weighting of the pitch gain over the N most recent frames is higher than a given threshold.

26. An instability eradication device as recited in claim 15, further comprising means for scaling down, when an overflow occurs in the synthesis filter in response to the past-excitation-signal component, said past-excitation-signal component in order to enhance eradication of the occasional instability.

27. An encoder system comprising:

an analysis-by-synthesis encoder section for encoding an input signal, comprising:

first means for producing, in response to said signal and at regular time intervals called frames, a description of an innovation signal to be supplied as excitation signal to a synthesis filter in view of synthesizing said signal;

second means for producing, in response to said signal and at said regular time intervals, a set of spectral parameters for use in driving the synthesis filter; and third means for producing, in response to said signal and at said regular time intervals, pitch information including a pitch gain for constructing a past-excitation-signal component added to said excitation signal; and an instability eradication section comprising:

detecting means for detecting a set of conditions related to the spectral parameters and the pitch gain; and modifying means for reducing the pitch gain to a value lower than a given threshold whenever the conditions of said set are detected in order to eradicate said occasional instability.

28. The encoder system of claim 27, wherein the conditions of said set comprise:

a resonance condition assessed from the spectral parameters;

a duration condition detected when the resonance condition has prevailed for at least the M most recent frames, M being an integer greater than 1; and a gain condition which evidences consistently-high values of the pitch gain in the N most recent frames, N being an integer greater than 1.

29. The encoder system of claim 27, in which said modifying means comprises means for reducing a quantized version of the pitch gain to a value lower than a given threshold $G_T$ whenever the conditions of said set are detected by the detecting means in order to eradicate said occasional instability.

30. The encoder system of claim 27, in which said modifying means comprises means for saturating the pitch gain to a given threshold whenever the conditions of said set are detected by said detecting means in order to eradicate said occasional instability.

31. The encoder system of claim 27, wherein said analysis-by-synthesis techniques use a vector quantizer for quantizing the pitch gain, and wherein said modifying means comprises means for limiting a search range of the vector quantizer to thereby cause the quantized pitch gain to be lower than a given threshold whenever the conditions of said set are detected by the detecting means in order to eradicate said occasional instability.

32. The encoder system of claim 28, wherein the spectral parameters are related to Line Spectral Pairs (LSP), and wherein the detecting means comprises:

means for comparing quantities $d_k$ to respective thresholds $T_k$; and means for detecting a resonance condition when at least one quantity $d_k$ is higher than the respective threshold $T_k$;

wherein said quantities $d_k$ are expressed by the following relation:

$$d_k=\min\{\mathrm{LSP}(i)-\mathrm{LSP}(i+1)\};\ \text{for } i=m_k, m_{k+1}, \ldots, n_k$$

where:

LSP(i) for I=1, 2, . . . P, denotes P spectral parameters of the Line Spectral Pairs (LSP);

k is an index; and $m_k$, $m_{k+1}$, . . . , $n_k$ are integers.

33. The encoder system of claim 32, comprising means for changing the value of at least one threshold $T_k$ in relation to the Line Spectral Pairs (LSP).

34. The encoder system of claim 32, wherein the index k takes on the two values 1 and 2, and wherein the detecting means comprises:

means for comparing the quantities $$d_1=\min\{LSP(i)-LSP(i+1)\};\ \text{for } i=4, 5, 6, 7, 8$$

$$d_2=\min\{LSP(i)-LSP(i+1)\};\ \text{for } i=2, 3$$

to the thresholds $T_1$ and $T_2$, respectively; and means for detecting a resonance condition when at least one of the quantities $d_1$ and $d_2$ is higher than the respective threshold $T_1$ or $T_2$.

35. The encoder system of claim 34, wherein the detecting means further comprises:

means for maintaining the threshold $T_1$ to a fixed value; and means for changing the value of the threshold $T_2$ in relation to the spectral parameter LSP(2).

36. The encoder system of claim 27, wherein the detecting means comprises means for detecting a gain condition when an average of the pitch gain over said N most recent frames is higher than a given threshold.

37. The encoder system of claim 27, wherein the detecting means comprises means for detecting a gain condition when a weighting of the pitch gain over the N most recent frames is higher than a given threshold.

38. The encoder system of claim 27, further comprising means for scaling down, when an overflow occurs in the synthesis filter in response to the past-excitation-signal component, said past-excitation-signal component in order to enhance eradication of the occasional instability.

39. In a cellular communication system for servicing a large geographical area divided into a plurality of cells, comprising:

mobile transmitter/receiver units;

cellular base stations respectively situated in said cells;

means for controlling communication between the cellular base stations;

a bidirectional wireless communication sub-system between each mobile unit situated in one cell and the cellular base station of said one cell, said bidirectional wireless communication sub-system comprising in both the mobile unit and the cellular base station (a) a transmitter including analysis-by-synthesis encoding means for encoding a speech signal and means for transmitting the encoded speech signal, and (b) a receiver including means for receiving a transmitted encoded speech signal and means for decoding the received encoded speech signal;

the improvement comprising the analysis-by-synthesis speech signal encoding means of the transmitter of at least a portion of said mobile units and cellular base stations provided with a encoder system comprising:

an analysis-by-synthesis encoder section for encoding the speech signal, comprising:

first means for producing, in response to the speech signal and at regular time intervals called frames, a description of an innovation signal to be supplied as excitation signal to a synthesis filter in view of synthesizing said speech signal;

second means for producing, in response to the speech signal and at said regular time intervals, a set of spectral parameters for use in driving the synthesis filter; and third means for producing, in response to the speech signal and at said regular time intervals, pitch information including a pitch gain for constructing a past-excitation-signal component added to said excitation signal; and an instability eradication section comprising:

detecting means for detecting a set of conditions related to the spectral parameters and the pitch gain; and modifying means for reducing the pitch gain to a value lower than a given threshold whenever the conditions of said set are detected in order to eradicate said occasional instability.

40. An encoder system as recited in claim 39, wherein the conditions of said set comprise:

a resonance condition assessed from the spectral parameters;

a duration condition detected when the resonance condition has prevailed for at least the M most recent frames, M being an integer greater than 1; and a gain condition which evidences consistently-high values of the pitch gain in the N most recent frames, N being an integer greater than 1.

41. An encoder system as recited in claim 39, in which said modifying means comprises means for reducing a quantized version of the pitch gain to a value lower than a given threshold $G_T$ whenever the conditions of said set are detected by the detecting means in order to eradicate said occasional instability.

42. An encoder system as recited in claim 39, in which said modifying means comprises means for saturating the pitch gain to a given threshold whenever the conditions of said set are detected by said detecting means in order to eradicate said occasional instability.

43. An encoder system as recited in claim 39, wherein said analysis-by-synthesis techniques use a vector quantizer for quantizing the pitch gain, and wherein said modifying means comprises means for limiting a search range of the vector quantizer to thereby cause the quantized pitch gain to be lower than a given threshold whenever the conditions of said set are detected by the detecting means in order to eradicate said occasional instability.

44. An encoder system as recited in claim 40, wherein the spectral parameters are related to Line Spectral Pairs (LSP), and wherein the detecting means comprises:

means for comparing quantities $d_k$ to respective thresholds $T_k$; and means for detecting a resonance condition when at least one quantity $d_k$ is higher than the respective threshold $T_k$;

wherein said quantities $d_k$ are expressed by the following relation:

$$d_k=\min\{LSP(i)-LSP(i+1)\};\ \text{for } i=m_k, m_{k+1}, \ldots, n_k$$

where:

LSP(i) for I=1, 2, . . . P, denotes P spectral parameters of the Line Spectral Pairs (LSP);

k is an index; and $m_k$, $m_{k+1}$, . . . , $n_k$ are integers.

45. An encoder system as recited in claim 44, comprising means for changing the value of at least one threshold $T_k$ in relation to the Line Spectral Pairs (LSP).

46. An encoder system as recited in claim 44, wherein the index k takes on the two values 1 and 2, and wherein the detecting means comprises:

means for comparing the quantities $$d_1=\min\{LSP(i)-LSP(i+1)\};\ \text{for } i=4, 5, 6, 7, 8$$

$$d_2=\min\{LSP(i)-LSP(i+1)\};\ \text{for } i=2, 3$$

to the thresholds $T_1$ and $T_2$, respectively; and means for detecting a resonance condition when at least one of the quantities $d_1$ and $d_2$ is higher than the respective threshold $T_1$ or $T_2$.

47. An encoder system as recited in claim 46, wherein the detecting means further comprises:

means for maintaining the threshold $T_1$ to a fixed value; and means for changing the value of the threshold $T_2$ in relation to the spectral parameter LSP(2).

48. An encoder system as recited in claim 40, wherein the detecting means comprises means for detecting a gain condition when an average of the pitch gain over said N most recent frames is higher than a given threshold.

49. An encoder system as recited in claim 39, wherein the detecting means comprises means for detecting a gain condition when a weighting of the pitch gain over the N most recent frames is higher than a given threshold.

50. An encoder system as recited in claim 39, wherein the encoded-speech-signal decoding means of the receiver of said at least a portion of said mobile units and cellular base stations comprises means for scaling down, when an overflow occurs in the synthesis filter in response to the past-excitation-signal component, said past-excitation-signal component in order to enhance eradication of the occasional instability.

* * * * *